US005411419A

United States Patent [19]

Ochi

[11] Patent Number: 5,411,419

[45] Date of Patent: May 2, 1995

[54] MULTIPOLE CONNECTION TERMINAL AND METHOD FOR PRODUCING SAME

[75] Inventor: Hiroyuki Ochi, Mie, Japan

[73] Assignee: Sumitomo Wiring Systems, Ltd., Mie, Japan

[21] Appl. No.: 109,444

[22] Filed: Aug. 20, 1993

[30] Foreign Application Priority Data

Sep. 3, 1992 [JP] Japan ..... 4-262895

[51] Int. Cl.[6] ..... H01R 13/11

[52] U.S. Cl. ..... 439/787; 439/851

[58] Field of Search ..... 439/842, 843, 848, 787, 439/850, 851; 29/882, 884

[56] References Cited

U.S. PATENT DOCUMENTS

| | | | |
|---|---|---|---|
| 3,162,503 | 12/1964 | Wanzecka | 439/787 |
| 3,263,202 | 7/1966 | Dean et al. | 439/787 |
| 3,594,714 | 7/1971 | Paullus et al. | 439/787 |
| 4,260,216 | 4/1981 | Ackerman | 439/787 |
| 5,197,906 | 3/1993 | Watanabe et al. | 439/787 |

FOREIGN PATENT DOCUMENTS 4413332 6/1969 Japan .

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

This invention is to provide a multipole connecting terminal which can join a plurality of electric cables in the same direction. The multipole connecting terminal comprises first and second terminal connecting portions 40*a* and 40*b* formed on the opposite sides of a first strip piece 21A of a metal plate 20 and third and fourth terminal connecting portions 40*c* and 40*d* formed on a second strip piece 21B bent toward the reverse side of the first strip piece 21A. The portions 40*a*, 40*b*, 40*c*, and 40*d* have openings in the same direction. It is possible to join each of male terminals 70 attached to each of electric cables 60 to each of the terminal connecting portions 40*a* through 40*d* while maintaining the cables 60 in a straight position without turning the cables 60. A connecting work of the male 70 becomes easy since the electric cables 60 are not turned around the multipole connecting terminal.

4 Claims, 10 Drawing Sheets

MULTIPOLE CONNECTION TERMINAL AND METHOD FOR PRODUCING SAME

BACKGROUND OF THE INVENTION

1. Field of the Invention

This invention relates to a multipole connecting terminal which is used in wiring parts in, for example, an automobile and is designed to receive a plurality of terminals, and to a method for producing the same.

2. Statement of the Prior Art

For convenience of explanation, a conventional multipole connecting terminal will be described by referring to the drawings.

FIG. 15 is a perspective view of a multipole connecting terminal T shown in, for example, Japanese Patent Publication No. 44-13332 (1969). As shown in FIG. 15, the multipole connecting terminal T comprises cylindrical portions 2, 2 which are formed by circularly bending opposite side areas of a metal plate 1 and are arranged parallel each other. Opposite end openings of the cylindrical portions 2, 2 constitute terminal connecting parts 3*a*, 3*b*, 3*c* and 3*d*. A main electric cable 5 is connected to a central area of the metal plate 1.

The multipole connecting terminal T to which the main electric cable 5 is attached is secured to a car body. A male terminal 11 attached to an end of an electric cable 10*a* is joined to the terminal connecting portions 3*a* of the multipole connecting terminal T. Similarly, male terminals of the other electric wires are joined to the other terminal connecting portions 3*b* to 3*d*, respectively, to form a multipole connection.

Since in the conventional multipole connecting terminal T the terminal connecting parts 3*a* to 3*d* are formed on the opposite end openings of the cylindrical portions 2, terminal receiving directions in the terminal connecting parts 3*a* and 3*b* formed in end openings of the cylindrical portions 2 are opposite to those in the terminal connecting parts 3*c* and 3*d* formed in the other end openings of the cylindrical portions 2.

Consequently, as shown in FIG. 16, when the electric cables 10*a* to 10*d* are joined to the multipole connecting terminal T, the electric cables 10*c* and 10*d* must be turned around the opposite sides of the terminal T, and the male terminals 11 of the cables 10*c* and 10*d* must be inserted into the terminal connecting parts 3*c* and 3*d*.

Accordingly, each of the electric cables 10*c* and 10*d* require an additional length of at least a length of the multipole connecting terminal T in comparison with the electric cables 10*a* and 10*b*, thereby resulting in increased costs. Also, the lengths of the electric cables 10*c* and 10*d* are usually minimized in order to hold down costs. In this case, since the cables 10*c* and 10*d* do not have sufficient lengths to turn around the terminal T, the male terminals 11 can not be readily inserted into the terminal connecting parts 3*c* and 3*d*, thus lowering efficiency in connecting the male terminals 11.

SUMMARY OF THE INVENTION

A first object of the present invention is to provide a multipole connecting terminal which can join a plurality of electric cables extending in the same direction thereby reducing the cost of connecting operations and increasing its efficiency.

A second object of the present invention is to provide a method for producing a multipole connecting terminal which can achieve the first object.

In order to achieve the first object, a multipole connecting terminal in accordance with the present invention is formed by bending a metal plate having a first strip piece and a second strip piece which are initially coplanar with each other and a coupling piece which interconnects intermediate areas of said first and second strip pieces. The multipole connecting terminals comprises: first and second cylindrical portions formed by circularly bending opposite end areas of said first strip piece toward one side of said metal plate so that the axes of said cylindrical portions are arranged in parallel; third and fourth cylindrical portions formed by circularly bending opposite end areas of said second strip piece toward one side of said metal plate so that the axes of said third and fourth cylindrical portions are arranged in parallel; and first through fourth terminal receiving parts formed by bending said second strip piece at said coupling piece toward the other side of said metal plate so that one-end openings of said first through fourth cylindrical portions are aligned along a plane.

In order to achieve the second object, a method for producing a multipole connecting terminal in accordance with the present invention, comprises the steps of: punching a metal plate material into a metal plate having a first strip piece and a second strip piece which are initially coplanar with each other and a coupling piece which interconnects intermediate areas of said first and second strip pieces; forming first and second cylindrical portions by circularly bending opposite end areas of said first strip piece toward one side of said metal plate so that the axes of said cylindrical portions are arranged in parallel; forming third and fourth cylindrical portions by circularly bending opposite end areas of said second strip piece toward one side of said metal plate so that the axes of said third and fourth cylindrical portions are arranged in parallel; and forming first through fourth terminal receiving ports by bending said second strip piece at said coupling piece toward the other side of said metal plate so that one-end openings of said first through fourth cylindrical portions are aligned in a plane.

According to the multipole connecting terminal of the present invention, since the first and second cylindrical portions formed on the opposite side areas of the first strip piece and the third and fourth cylindrical portions formed on the opposite side areas of the second strip piece are aligned with respect to the directions of the openings, the terminals attached to the ends of the electric cables can be joined to the cylindrical portions while maintaining the electric cables in the straight position without turning the cable around the multipole connecting terminal.

According to the method of the present invention for producing a multipole connecting terminal, the above multipole connecting terminal can be produced by the processes specified in the method.

DETAILED DESCRIPTION OF THE PREFERRED EMBODIMENTS:

Referring now to FIGS. 1 through 14, embodiments of a multipole connecting terminal of the present invention and a method for producing the same will be described below.

Figure 1:
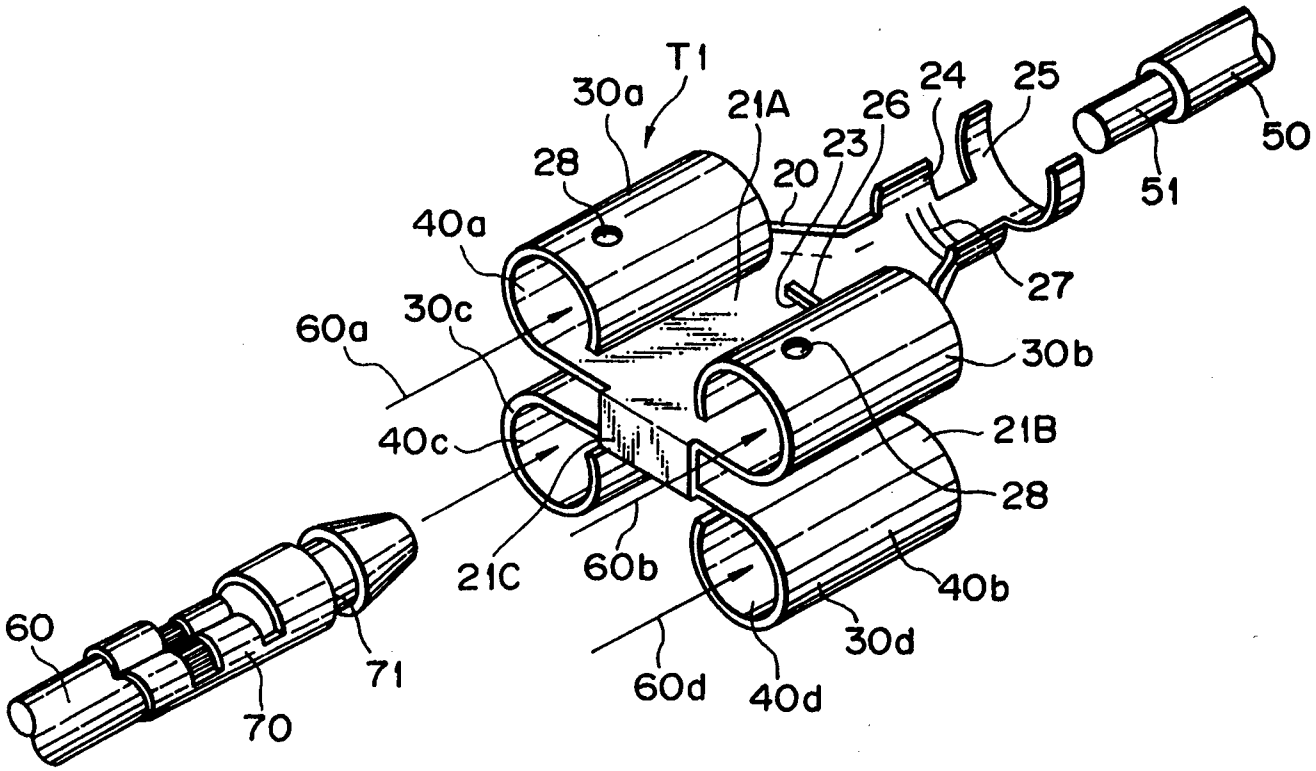
FIG. 1 is a perspective view of an embodiment of a multipole connecting terminal in accordance with the present invention.

FIG. 1 is a perspective view of an embodiment of a multipole connecting terminal T1 of the present invention. As shown in FIG. 1, the multipole connecting terminal T1 is made of a sheet of a metal plate. The terminal T1 will be explained in accordance in the order of producing steps.

Figure 2:
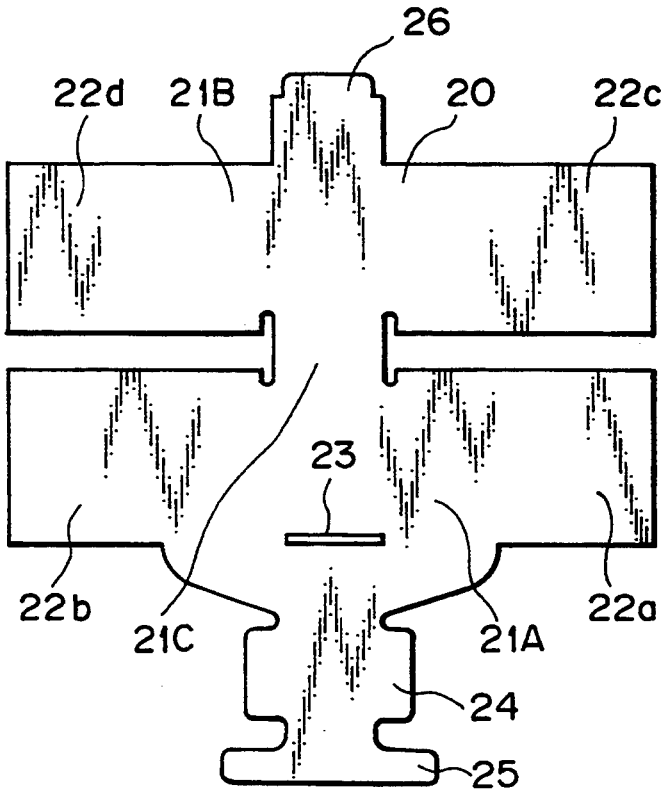
FIG. 2 is a plan view of the terminal under a forming step, which illustrates a method for producing the embodiment of the terminal.

First, as shown in FIG. 2, a metal plate 20 is punched into a given shape. The metal plate 20 includes a first strip piece 21A, a second strip piece 21B which is initially coplanar with the first strip piece 21A, a coupling piece 21C which interconnects intermediate areas of the strip pieces 21A and 21B, and a conductor attaching area 24 and a sheath attaching area 25 on the first strip piece 21A. The first strip piece 21A is provided with a positioning hole 23 at the approximate center thereof while the second strip piece 21B is provided with a positioning tongue 26 to be inserted into the positioning hole 23.

Figure 3:
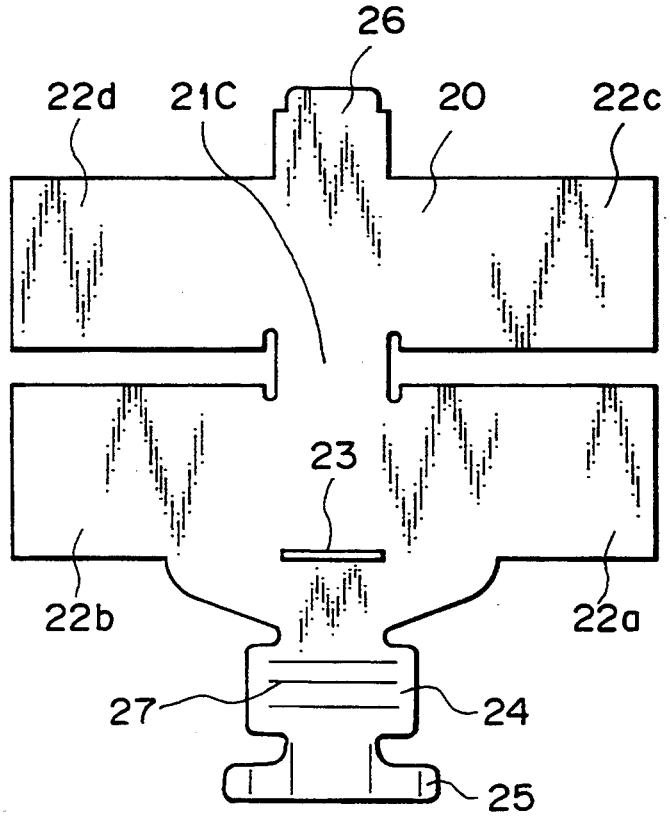
FIG. 3 is a plan view of the terminal under a forming step, which illustrates the method for producing the embodiment of the terminal.

Second, as shown in FIG. 3, the conductor attaching area 24 and the sheath attaching area 25 on the metal plate 20 are provided with serrations 27 formed by a stamping work.

Figure 4:
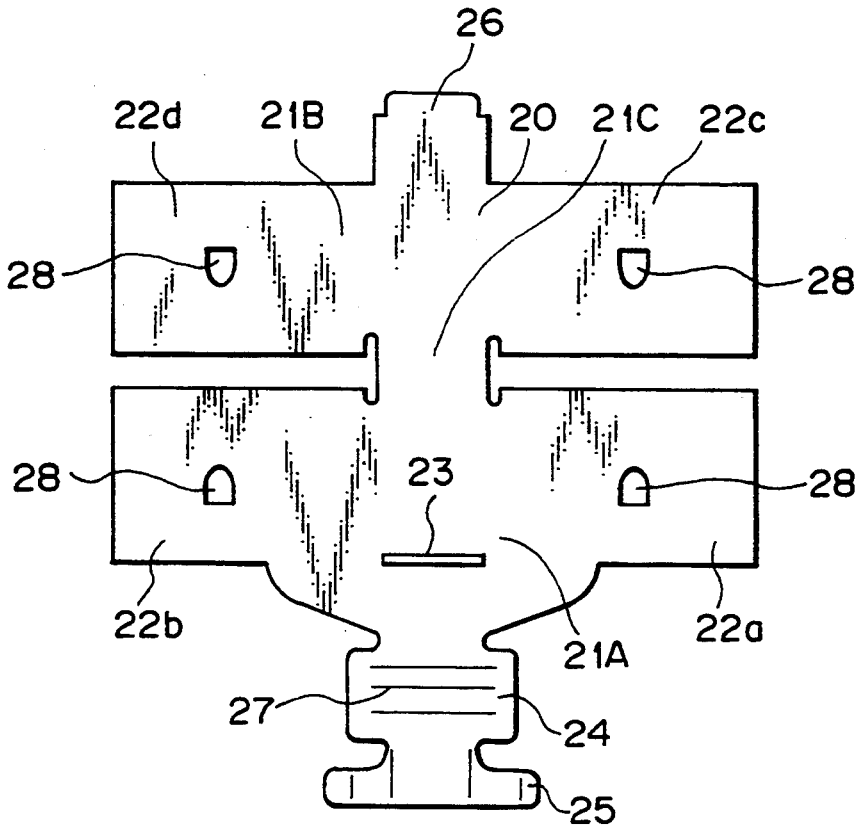
FIG. 4 is a plan view of the terminal under a forming step, which illustrates the method for producing the embodiment of the terminal.

Third, as shown in FIG. 4, the first and second strip pieces 21A and 21B are provided approximately at the center of the opposite side areas 22*a* to 22*d* with engaging recesses 28 which project from the surface of the drawing (the front side of the metal plate 20).

Figure 5:
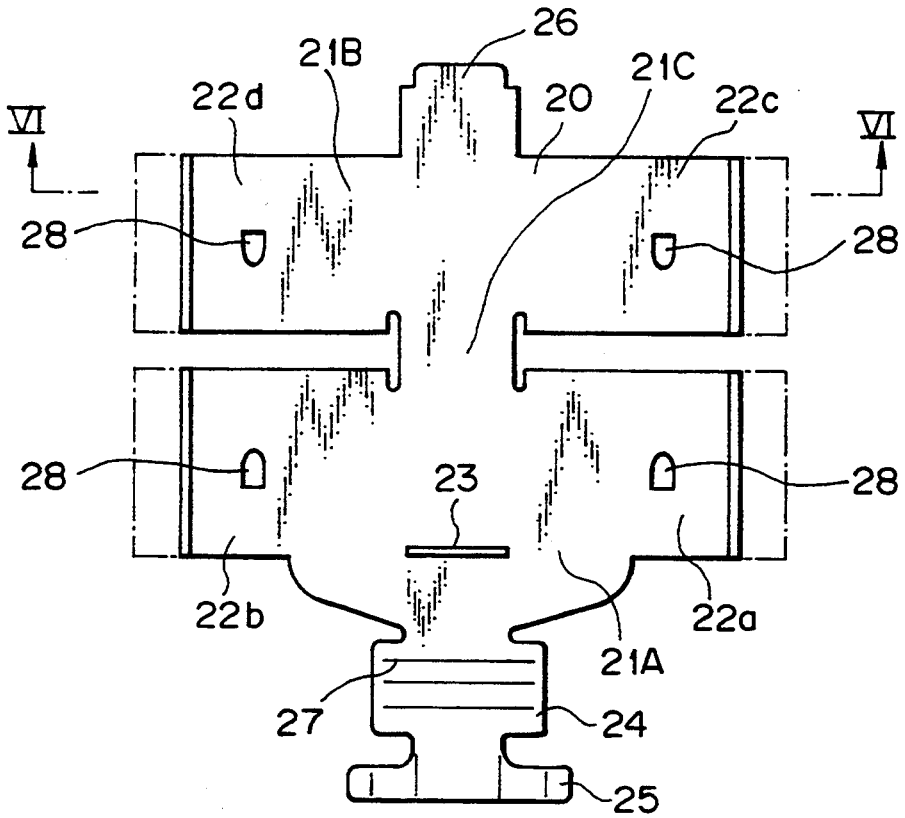
FIG. 5 is a plan view of the terminal under a forming step, which illustrates the method for producing the embodiment of the terminal.
Figure 6:
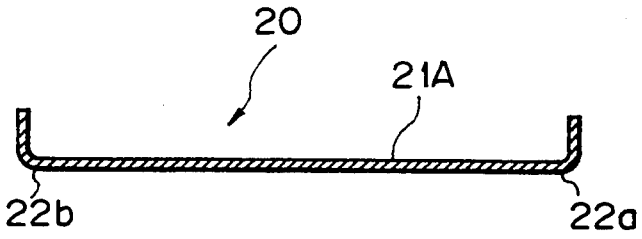
FIG. 6 is a cross sectional view taken along lines VI—VI in FIG. 5, which illustrates the method for producing the embodiment of the terminal.
Figure 7:
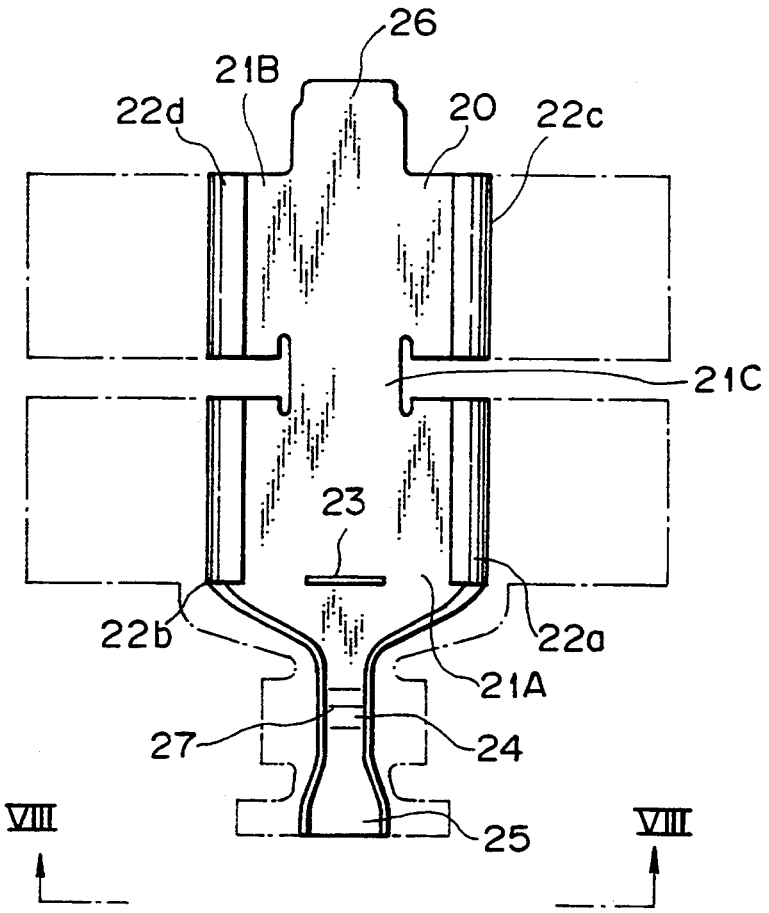
FIG. 7 is a plan view of the terminal under a forming step, which illustrates the method for producing the embodiment of the terminal.
Figure 8:
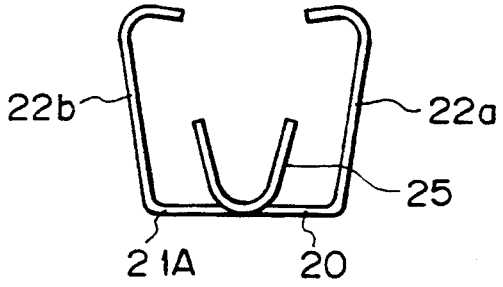
FIG. 8 is a front side view taken along lines VIII—VIII in FIG. 8, which illustrates the method for producing the embodiment of the terminal.
Figure 9:
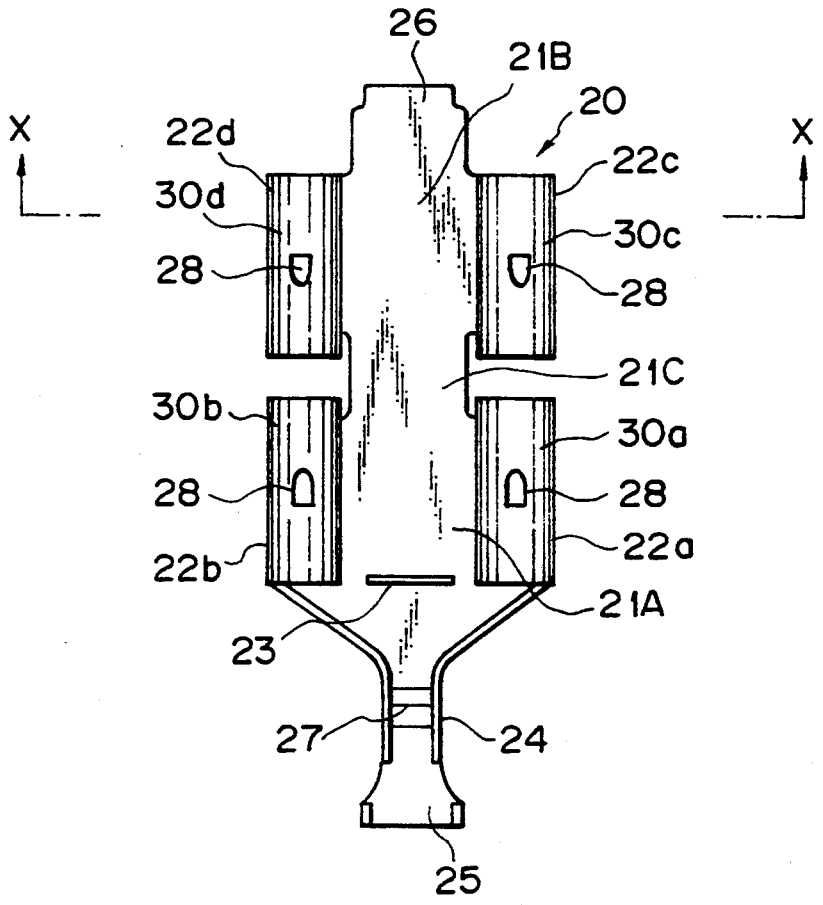
FIG. 9 is a plan view of the terminal under a forming step, which illustrates the method for producing the embodiment of the terminal.
Figure 10:
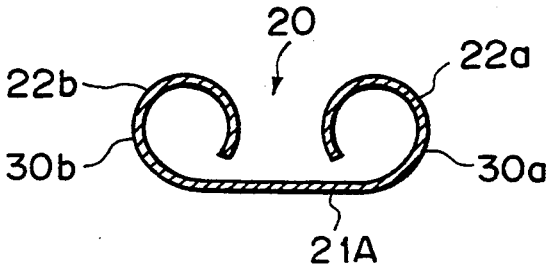
FIG. 10 is a cross sectional view taken along lines X—X in FIG. 9, which illustrates the method for producing the embodiment of the terminal.

Fourth, as shown in FIGS. 5 and 6, side ends of the opposite side areas 22*a* to 22*d* are bent to the front side of the metal plate 20. Further, after the opposite side areas 22*a* to 22*d* are bent, the conductor attaching area 24, and the sheath attaching area 25 are bent to the front side of the metal plate 20 at the vicinity of the center as shown in FIGS. 7 and 8, and the opposite side areas 22*a* to 22*d* are turned circularly to the front side of the metal plate so that the first to fourth cylindrical portions 30*a* to 30*d* are formed. The axes of the first to fourth cylindrical portions 30*a* to 30*d* are aligned in the same direction. The axes of the first and third cylindrical portions 30*a* and 30*c* are disposed along one line while the axes of the second and fourth cylindrical portions 30*b* and 30*d* are disposed along the other line.

Figure 11:
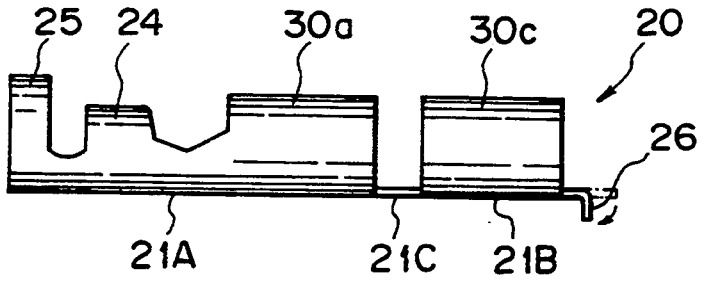
FIG. 11 is a side view of FIG. 9, which illustrates the method for producing the embodiment of the terminal.
Figure 12:
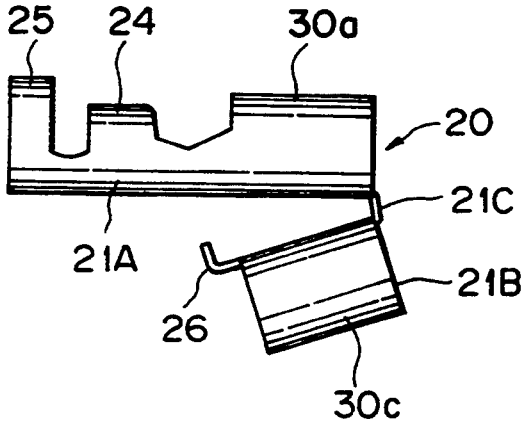
FIG. 12 is a side view of the terminal under a forming step, which illustrates the method for producing the embodiment of the terminal.
Figure 13:
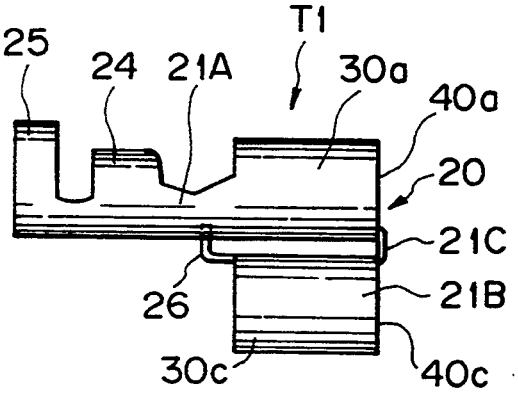
FIG. 13 is a side view of the terminal under a forming step, which illustrates the method for producing the embodiment of the terminal.

Fifth, after the positioning tongue 26 is bent at the end by about 90 degrees toward the reverse side of the metal plate as shown in FIG. 11, the second strip piece 21B is bent at the coupling piece 21C toward the reverse side of the first strip piece 21A as shown in FIGS. 12 and 13 until the positioning tongue 26 is inserted into the positioning hole 23 (see FIG. 2). Consequently, the axes of the third and fourth cylindrical portions 30*c* and 30*d* are arranged in parallel with the axes of the first and second cylindrical portions 30*a* and 30*b*.

Thus, as shown in FIG. 1, openings in one end of the first to fourth cylindrical portions 30*a* to 30*d* constitute first to fourth terminal receiving parts 40*a* to 40*d* which are directed in the same direction in the multipole connecting terminal T1.

In order to attach the main electric cable 50 to the multipole connecting terminal T1, the sheath of the electric cable 50 is stripped off at an end thereof to expose conductors 51, and the conductors 51 are pressed on the conductor attaching area 24 of the multipole connecting terminal T1. That is, the main electric cable 50 is attached to the multipole connecting terminal T1, so that the conductors 51 are clamped by the conductor attaching area 24, and the sheathed end of the electric cable 50 is clamped by the sheath attaching area 25.

Then, the multipole connecting terminal T1 to which the main electric cable 50 is attached is secured to the car body or the like, and male terminals 70, attached to the electric cables 60, are joined to the terminal receiving parts 40*a* to 40*d*. That is, as shown in FIG. 1, the male terminal 70 is prevented from falling out of the terminal receiving part 40*c* by locking the engaging recess 28 which projects from the interior of the third terminal receiving part 40*c* into an annular groove 71 formed around the outer periphery on an end of the male terminal 70. Similarly, the other male terminals 70 attached to the other electric cables 60 are joined to the first, second, and fourth terminal receiving terminals 40*a*, 40*b*, and 40*d* as shown by arrows 60*a*, 60*b*, and 60*d*, respectively.

Figure 16:
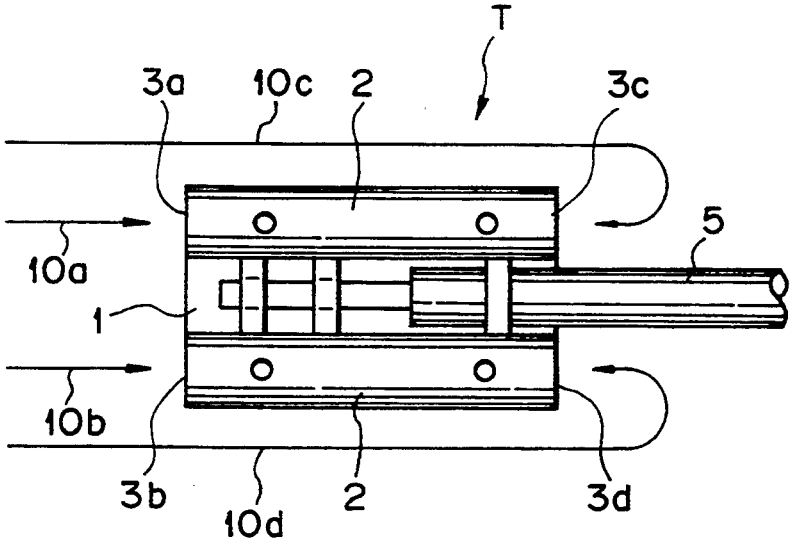
FIG. 16 is a plan view of FIG. 15 which illustrates a manner of using the conventional terminal.

Since the first to fourth terminal receiving parts 40*a* to 40*d* in the multipole connecting terminal T1 are opened in the same direction, the male terminals 70, attached to the ends of the electric cables 60, can be inserted into the terminal receiving parts 40*a* to 40*d* while maintaining the cables 60 in a straight position without having to turn the cables. While in the conventional multipole connecting terminal the cables to be joined had to be turned around the terminal T (see FIG. 16), in the present invention, the male terminals 70 can be inserted into the terminal receiving parts 40*a* to 40*d* in the multipole connecting terminal T1 while maintaining the electric cables in a straight position, thereby increasing the efficiency of the connecting work. Also, since the electric cables 60 to be joined are not turned around the terminal T1, the cables 60 are shortened in length, thereby reducing cable cost.

Further, since the multipole connecting terminal can be formed by bending a sheet of the metal plate 20, the number of parts is not increased.

Figure 14:
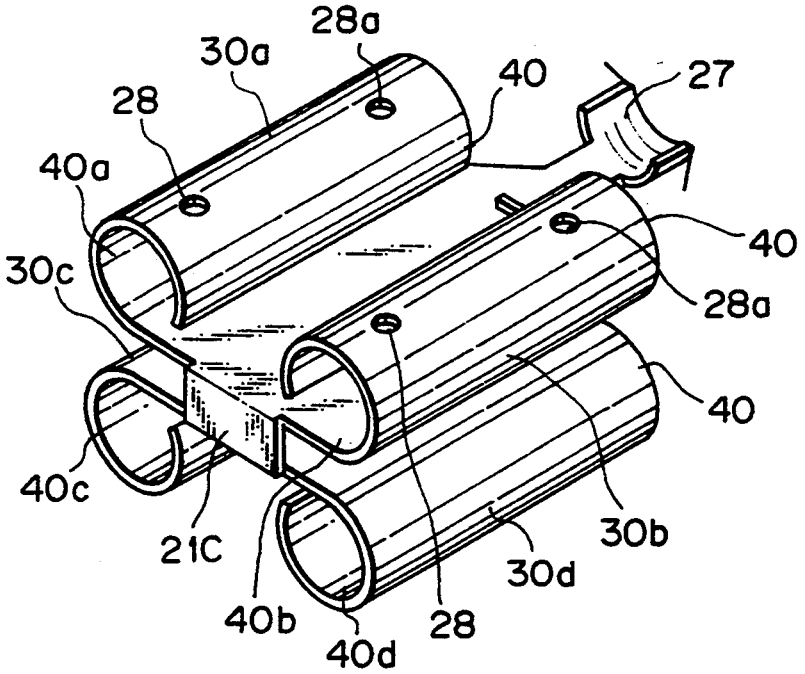
FIG. 14 is a perspective view of another embodiment of the multipole connecting terminal in accordance with the present invention.
Figure 15:
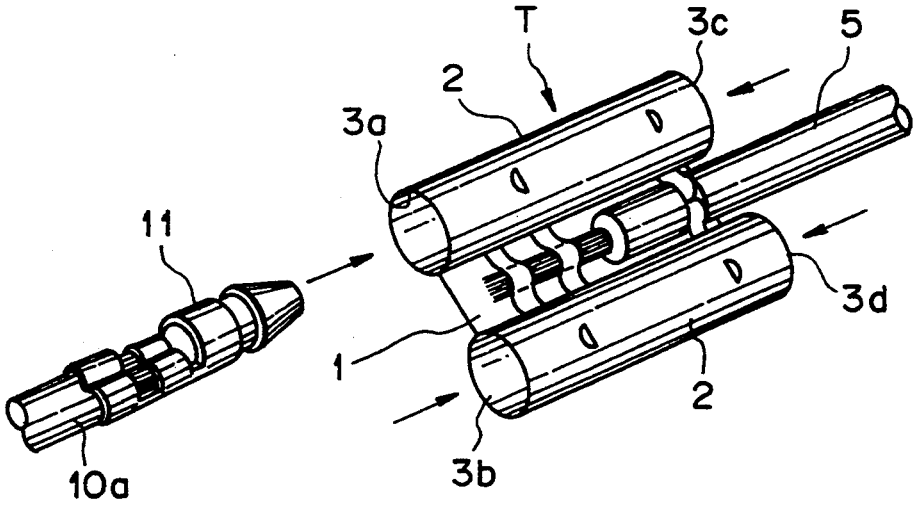
Fig. 15 PRIOR ART
FIG. 15 is a perspective view of a conventional multipole connecting terminal.

As shown in FIG. 14, the first to fourth cylindrical portions 30*a* to 30*d* may be formed in a larger size in the axial direction than those in FIG. 1 so that the engaging recesses 28*a* are formed on the barrels of the other ends of the portions 30*a* to 30*d* and terminal receiving parts 40 are formed in the other ends of the portions. This enables eight electric cables 60 to be joined to the respective terminal receiving parts 40 and 40*a* to 40*d*.

As described above, according to the multipole connecting terminal of the present invention, since the first and second terminal receiving parts formed on the opposite side areas on the first strip piece are aligned in the directions of openings with the third and fourth terminal connecting parts formed on the opposite side areas on the second strip piece, the terminals attached to the ends of the electric cables to be joined can be inserted straight to the terminal receiving parts respectively without turning the cable around the multipole connecting terminal. Accordingly, there is no need to turn the cable around the multipole terminal as effected in the conventional manner, the connecting work of the terminals is simplified, the cables are shortened in length, and the cost of the cable is lowered.

The method of the present invention can produce the multipole connecting terminal having the same construction as described above.

What is claimed is:

1. A multipole connecting terminal formed by bending a metal plate having a first strip piece including a positioning hole, a second strip piece including a positioning tongue integral at one side thereof, said first strip piece and said second strip piece being initially coplanar with each other, and a coupling piece which interconnects intermediate areas of said first and second strip pieces, further comprising:

first and second cylindrical portions formed by circularly bent opposite end areas of said first strip piece and which are bent toward one side of said metal plate so that the axes of said cylindrical portions are arranged in parallel;

third and fourth cylindrical portions formed by circularly bent opposite end areas of said second strip piece and which are bent toward one side of said metal plate so that the axes of said third and fourth cylindrical portions are arranged in parallel; and first through fourth terminal receiving parts formed by bending said second strip piece at said coupling piece toward the other side of said metal plate so that end openings of said first through fourth cylindrical portions are aligned in a plane and said first and second strip pieces are parallel to one another;

wherein said positioning tongue is inserted into said positioning hole when said first strip piece and said second strip piece are arranged in parallel with each other thereby to secure said first and second strip pieces together.

2. A method for producing a multipole connecting terminal, comprising the steps of:

punching a metal plate material into a metal plate having a first strip piece including a positioning hole, a second strip piece including a positioning tongue integral at one side thereof, said first strip piece and said second strip piece being initially coplanar with each other, and a coupling piece which interconnects intermediate areas of said first and second strip pieces;

forming first and second cylindrical portions by circularly bending opposite end areas of said first strip piece toward one side of said metal plate so that the axes of said cylindrical portions are arranged in parallel;

forming third and fourth cylindrical portions by circularly bending opposite end areas of said second strip piece toward one side of said metal plate so that the axes of said third and fourth cylindrical portions are arranged in parallel;

forming first through fourth terminal receiving parts by bending said second strip piece at said coupling piece toward the other side of said metal plate so that end openings of said first through fourth cylindrical portions are aligned in a plane and said first and second strip pieces are parallel to one another; and inserting said positioning tongue into said positioning hole when said first strip piece and said second strip piece are arranged in parallel with each other thereby to secure said first and second strip pieces together.

3. A multipole connecting terminal for receiving a plurality of terminals formed by bending a metal plate having a first strip piece, including a positioning hole, a second strip piece including a positioning tongue integral at one side thereof, said first strip piece and said second strip piece being initially coplanar with each other, and a coupling piece which interconnects intermediate areas of said first and second strip pieces, further comprising:

first and second cylindrical portions formed by circularly bent opposite end areas of said first strip piece and which are bent toward one side of said metal plate so that the axes of said cylindrical portions are arranged in parallel;

third and fourth cylindrical portions formed by circularly bent opposite end areas of said second strip piece and which are bent toward one side of said metal plate so that the axes of said third and fourth cylindrical portions are arranged in parallel; and first through fourth terminal receiving parts formed by bending said second strip piece at said coupling piece toward the other side of said metal plate so that end openings of said first through fourth cylindrical portions are aligned in a plane and said first and second strip pieces are parallel to one another;

wherein each of said end openings of said first through fourth cylindrical portions receives a corresponding one of said terminals, and further wherein said positioning tongue is inserted into said positioning hole when said first strip piece and said second strip piece are arranged in parallel with each other thereby to secure said first and second strip pieces together.

4. A method for producing a multipole connecting terminal for receiving a plurality of terminals, comprising the steps of:

punching a metal plate material into a metal plate having a first strip piece including a positioning hole, a second strip piece including a positioning tongue integral at one side thereof, said first strip piece and said second strip piece being initially coplanar with each other, and a coupling piece which interconnects intermediate areas of said first and second strip pieces;

forming first and second cylindrical portions by circularly bending opposite end areas of said first strip piece toward one side of said metal plate so that the axes of said cylindrical portions are arranged in parallel;

forming third and fourth cylindrical portions by circularly bending opposite end areas of said second strip piece toward one side of said metal plate so that the axes of said third and fourth cylindrical portions are arranged in parallel; and forming first through fourth terminal receiving parts by bending said second strip piece at said coupling piece toward the other side of said metal plate so that end openings of said first through fourth cylindrical portions are aligned in a plane and said first and second strip pieces are parallel to one another;

wherein each of said end openings of said first through fourth cylindrical portions receives a corresponding one of said terminals, and further wherein said positioning tongue is inserted into said positioning hole when said first strip piece and said second strip piece are arranged in parallel with each other thereby to secure said first and second strip pieces together.

* * * * *